US008714947B2

(12) United States Patent
Asai

(10) Patent No.: US 8,714,947 B2
(45) Date of Patent: May 6, 2014

(54) AIR COMPRESSOR

(75) Inventor: Masatoshi Asai, Tokyo (JP)

(73) Assignee: Max Co., Ltd., Tokyo (JP)

( * ) Notice: Subject to any disclaimer, the term of this patent is extended or adjusted under 35 U.S.C. 154(b) by 122 days.

(21) Appl. No.: 13/439,432

(22) Filed: Apr. 4, 2012

(65) Prior Publication Data

US 2012/0257992 A1 Oct. 11, 2012

(30) Foreign Application Priority Data

Apr. 5, 2011 (JP) ..... 2011-083461

(51) Int. Cl.
*F04B 35/04* (2006.01)
*F04B 35/06* (2006.01)
*F04B 23/02* (2006.01)

(52) U.S. Cl.
CPC ..... *F04B 23/028* (2013.01); *F04B 35/06* (2013.01)
USPC ..... 417/423.15; 417/234

(58) Field of Classification Search
CPC ..... F04B 35/06; F04B 23/02; F04B 23/025; F04B 23/028
USPC ..... 417/234, 415, 423.15, 423.14
See application file for complete search history.

(56) References Cited

U.S. PATENT DOCUMENTS 1,756,806 A * 4/1930 Beach ..... 137/899.4
2009/0016904 A1* 1/2009 Mannen et al. ..... 417/279
2009/0194177 A1* 8/2009 Yokota et al. ..... 137/565.18

* cited by examiner

*Primary Examiner* — Bryan Lettman
(74) *Attorney, Agent, or Firm* — Drinker Biddle & Reath LLP

(57) ABSTRACT

An air compressor is provided. The air compressor includes a compression mechanism including a cylinder to generate compressed air, a motor provided to drive the compression mechanism, an inverter board including an inverter to control a rotation of the motor, two elongated tanks provided to store the compressed air generated by the cylinder, and a fan rotated by the motor to supply cooling air. The tanks are arranged below the cylinder and the motor, and the inverter board is arranged between the cylinder and the tanks.

9 Claims, 8 Drawing Sheets

AIR COMPRESSOR

CROSS-REFERENCE TO RELATED APPLICATION(S)

The present application claims the benefit of priority of Japanese Patent Application No. 2011-083461, filed on Apr. 5, 2011, the disclosure of which is incorporated herein by reference.

TECHNICAL FIELD

The present invention relates to an air compressor including twin tanks and an inverter board.

BACKGROUND

Generally, an air compressor includes a cylinder attached to a side portion of a crankcase to receive a compression piston in slidable manner. A rotary shaft is provided inside the crankcase in a rotatable manner. A connecting rod is attached to the rotary shaft via an eccentric disk, and the distal end of the connecting rod is connected to the compression piston inside the cylinder. When the eccentric disk is rotated together with the rotary shaft by a motor, the compression piston connected to the connecting rod reciprocates inside the cylinder, thereby compressing the air introduced into the cylinder. The compressed air is fed to and stored in an air tank through a connecting pipe connecting the cylinder and the tank.

For example, JP 4230601 B2 discloses an air compressor including two storage tanks disposed side by side in a spaced manner, and a power supply control unit having an inverter control portion and interposed between the storage tanks.

With regard to such an air compressor, there is a demand for reducing its projected area at the time of installation. This is because, when installing the air compressor in a construction site, the air compressor is often installed in a narrow space such as an entrance space to prevent a floor surface from being damaged.

However, according to the air compressor disclosed in JP 4230601 B2, a certain distance is provided between the two storage tanks to ensure an insulating distance for the inverter control portion, which increases the projected area of the air compressor at the time of installation.

Further, when the air compressor is roughly placed on stones or wood pieces, the power supply control unit may be damaged, as nothing is provided below the power supply control unit. Thus, in order to ensure safety such as insulation, strength is required for a casing of the power supply control unit, which increases weight and manufacturing cost.

SUMMARY

Illustrative aspects of the present invention provide an air compressor having a reduced projected area at the time of installation and can secure safety of an inverter board with a minimum protection.

According to an illustrative aspect of the present invention, an air compressor is provided. The air compressor includes a compression mechanism including a cylinder to generate compressed air, a motor provided to drive the compression mechanism, an inverter board including an inverter to control a rotation of the motor, two elongated tanks provided to store the compressed air generated by the cylinder, and a fan rotated by the motor to supply cooling air. The tanks are arranged below the cylinder and the motor, and the inverter board is arranged between the cylinder and the tanks.

Other aspects and advantages of the present invention will be apparent from the following description, the drawings, and the claims.

DETAILED DESCRIPTION

Hereinafter, an exemplary embodiment of the present invention will be described in detail with reference to the drawings.

Figure 1A:
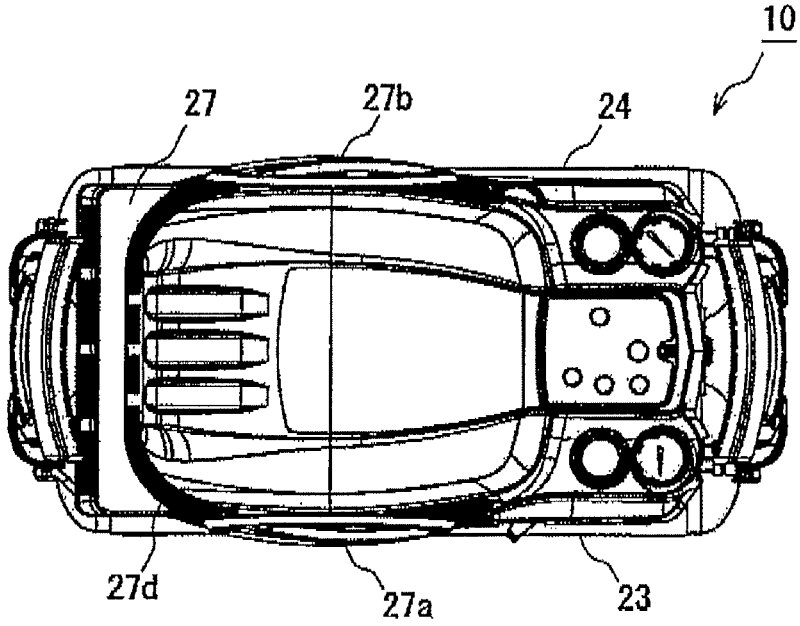
FIG. 1A is a plan view of an air compressor according to an exemplary embodiment of the present invention.
Figure 1B:
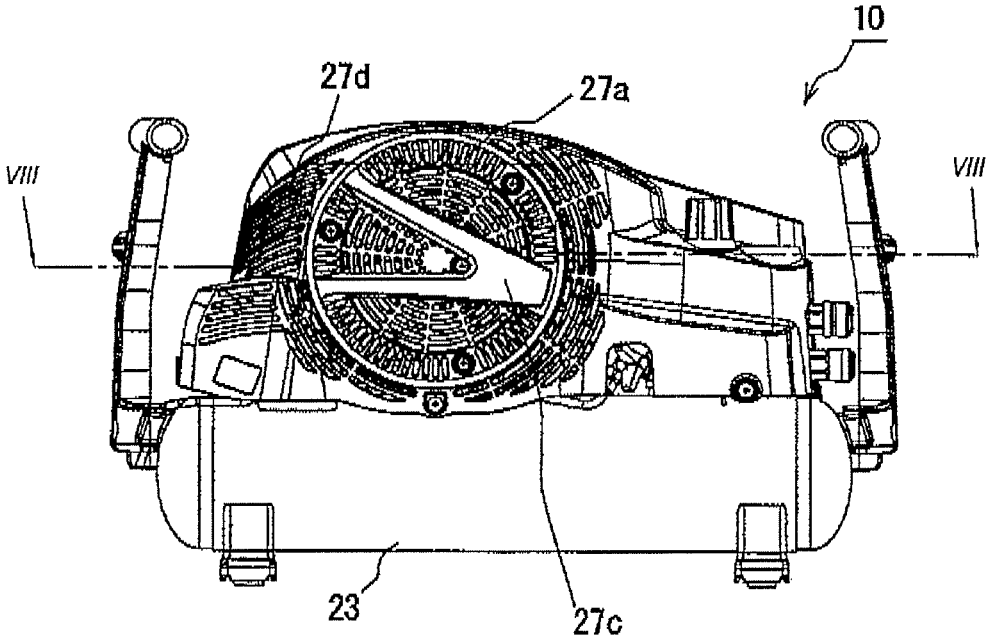
FIG. 1B is a front view of the air compressor.
Figure 2:
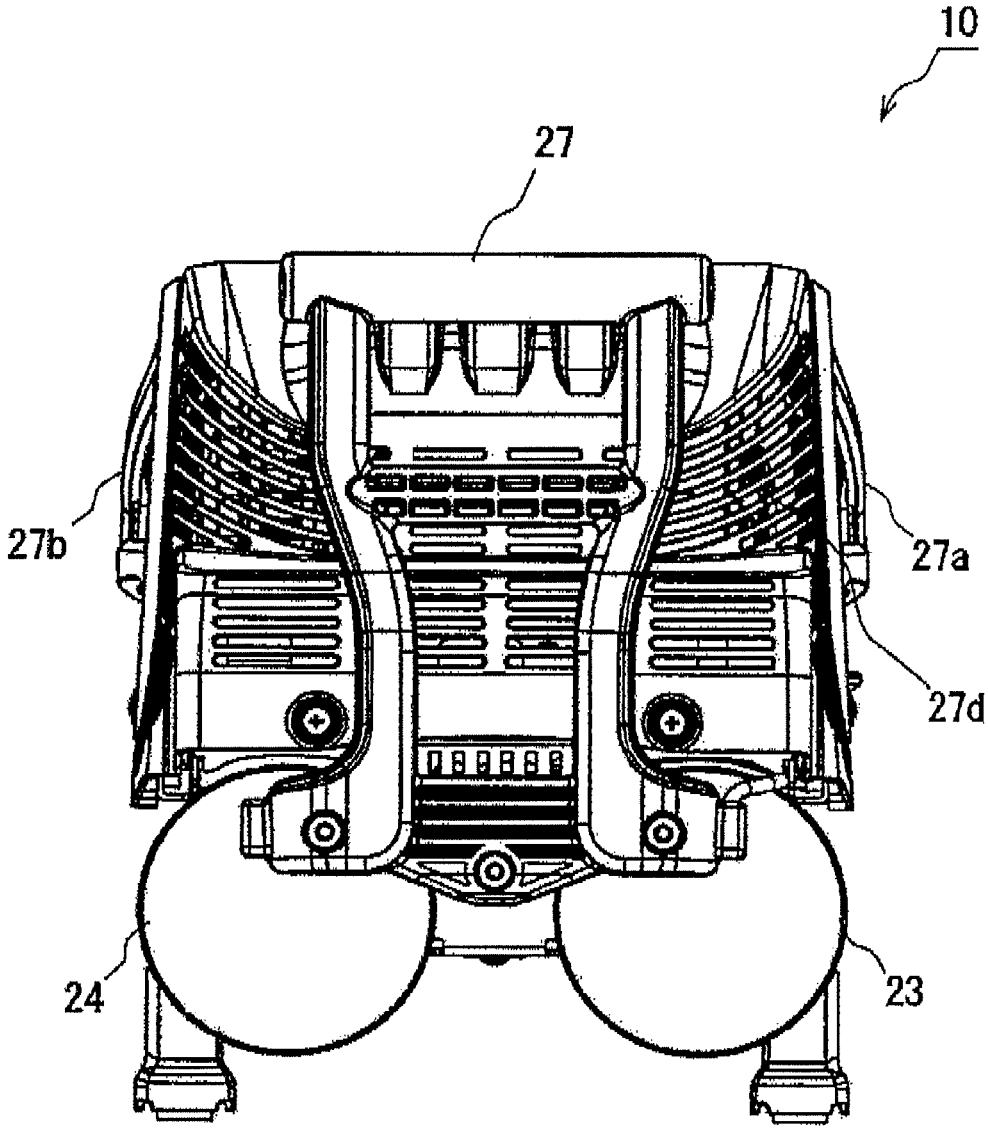
FIG. 2 is a side view of the air compressor.

As shown in FIGS. 1A to 2, an air compressor 10 according to an exemplary embodiment is configured such that first and second elongated tanks 23, 24 for storing compressed air are arranged in parallel, and such that a cover 27 covers the devices provided above the first and second tanks 23, 24.

A compressor main body 11, an inverter board 21 and a fan 25 are arranged inside the cover 27. The compressor main body 11 is driven by a motor 20 to generate compressed air. The inverter board 21 includes an inverter to control the rotation of the motor 20. The fan 25 is arranged to rotate coaxially with the motor 20 to supply cooling air.

The compressor main body 11 includes a crankcase 12 provided on one end of the motor 20, and a primary and secondary compression mechanisms 13, 14 disposed on respective sides of the crankcase 12 to carry out two-stage compression.

The primary compression mechanism 13 includes a primary cylinder 13*a* to generate compressed air, and is driven by the motor 20.

Similarly, the secondary compression mechanism 14 includes a secondary cylinder 14*a* to generate compressed air, and is driven by the motor 20.

Figure 3A:
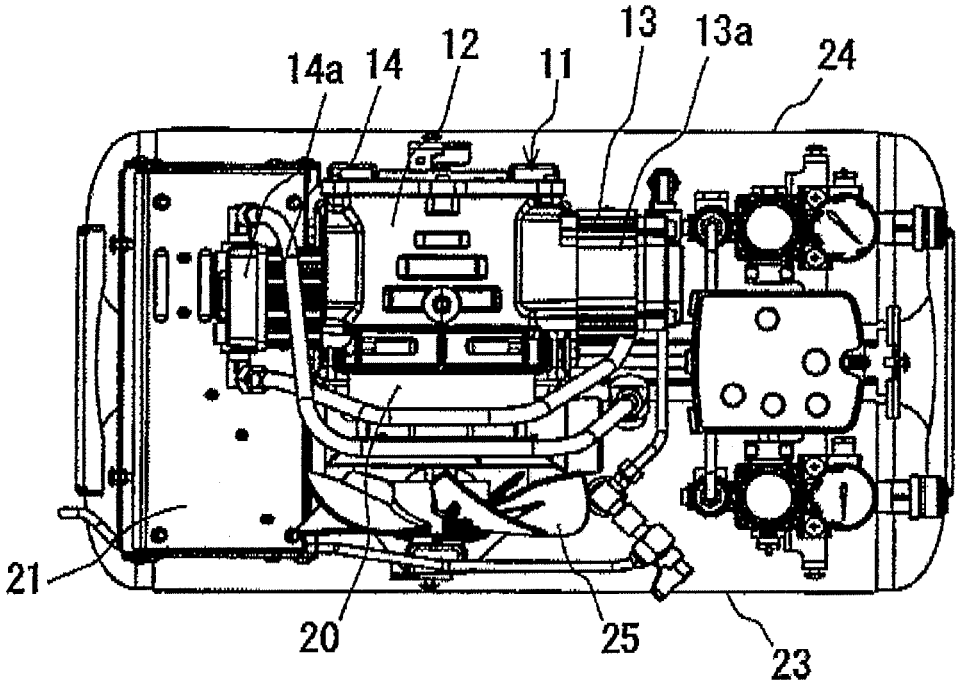
FIG. 3A is a plan view of the air compressor from which a cover is removed.
Figure 3B:
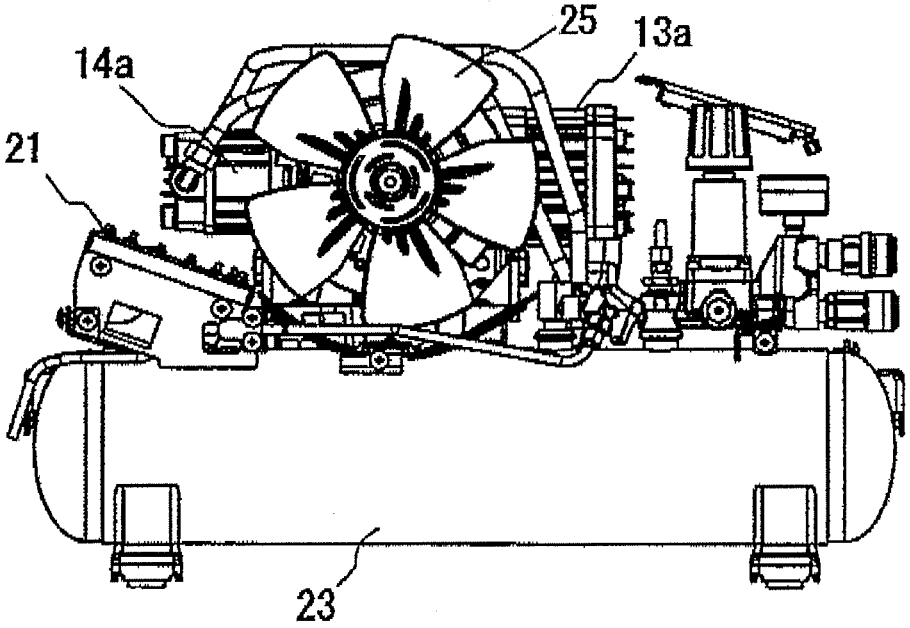
FIG. 3B is a front view of the air compressor from which the cover is removed.

As shown in FIGS. 3A and 3B, the primary compression mechanism 13 and secondary compression mechanism 14 are disposed on the respective sides of the crankcase 12 to protrude in opposite directions.

Figure 7:
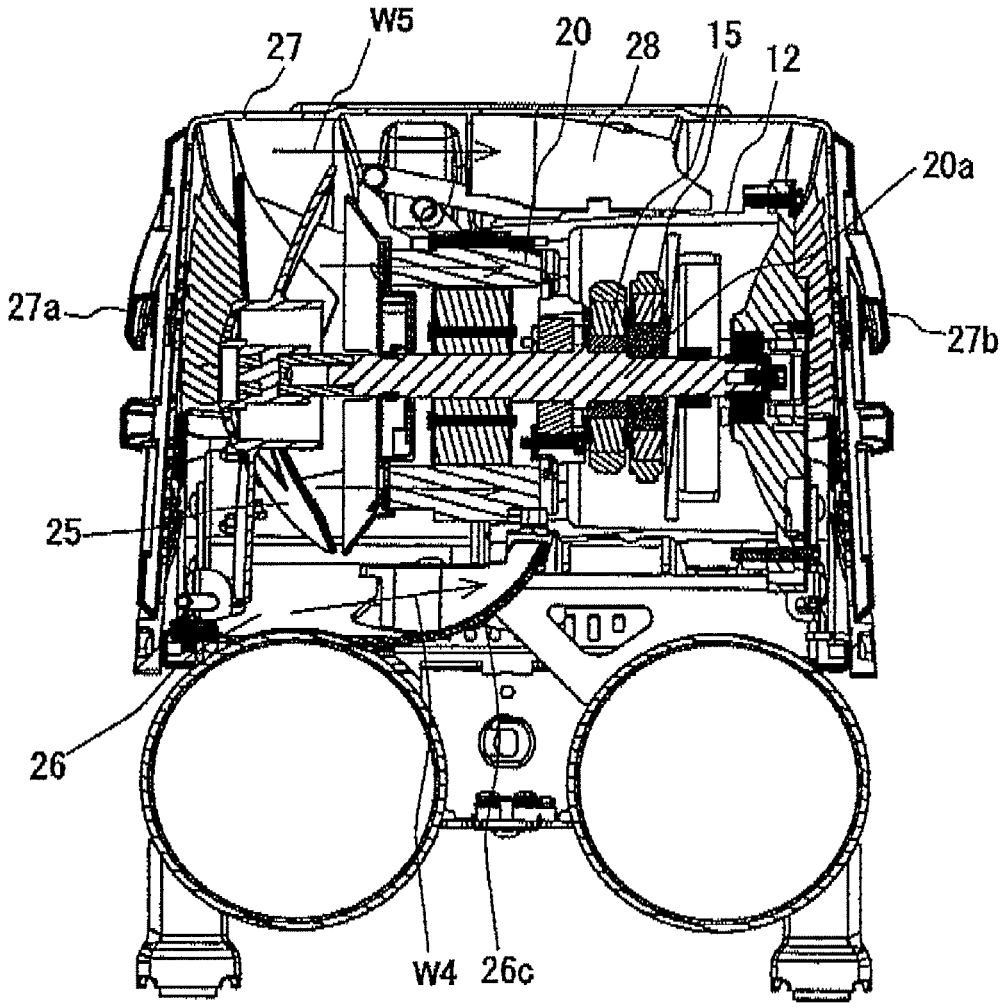
FIG. 7 is a sectional view of the air compressor, illustrating flows of the cooling air inside the air compressor.

As shown in FIG. 7, the motor 20 is provided on the end portion of the crankcase 12. The motor 20 is a DC brushless motor in which a rotary shaft 20*a* is rotated by electromagnetic force acting between a rotor and a stator, and is driven by an inverter control. The rotary shaft 20*a* of the motor 20 is extended into the crankcase 12 and is rotatably supported inside the crankcase 12.

Two eccentric disks 15 are fixed to the rotary shaft 20*a* inside the crankcase 12, and connecting rods (not shown) are connected to the respective eccentric disks 15 via bearings. One of the connecting rods is connected to the compression piston of the primary compression mechanism 13, and the other connecting rod is connected to the compression piston of the secondary compression mechanism 14.

The compression piston of the primary compression mechanism 13 is slidably received in the cylindrical primary cylinder 13*a*. Similarly, the compression piston of the secondary compression mechanism 14 is slidably received in the cylindrical secondary cylinder 14*a*. External air is introduced into the primary cylinder 13*a* of the primary compression mechanism 13. Specifically, the external air is introduced into the crankcase 12 from an inlet (not shown) formed in the crankcase 12, and is then taken into the primary cylinder 13*a* from a check-valved introduction hole (not shown) formed through the compression piston of the primary compression mechanism 13. The primary cylinder 13*a* of the primary compression mechanism 13 and the secondary cylinder 14*a* of the secondary compression mechanism 14 axe connected to each other through a pipe, and the secondary cylinder 14*a* of the secondary compression mechanism 14 and first tank 23 are connected to each other through another pipe. The first tank 23 communicates with the second tank 24.

When the rotary shaft 20*a* of the motor 20 is rotated, and the rotation movement is converted into rectilinear reciprocating movement by the eccentric disk 15 and connecting rod of the primary compression mechanism 13, whereby the compression piston reciprocates inside the primary cylinder 13*a*. The air inside the primary cylinder 13*a* is compressed by this reciprocating movement, and is supplied to the secondary cylinder 14*a* of the secondary compression mechanism 14 through the pipe. The air inside the secondary cylinder 14*a* is also compressed in a similar manner, and is supplied to and stored in the air tanks 23, 24.

Figure 4:
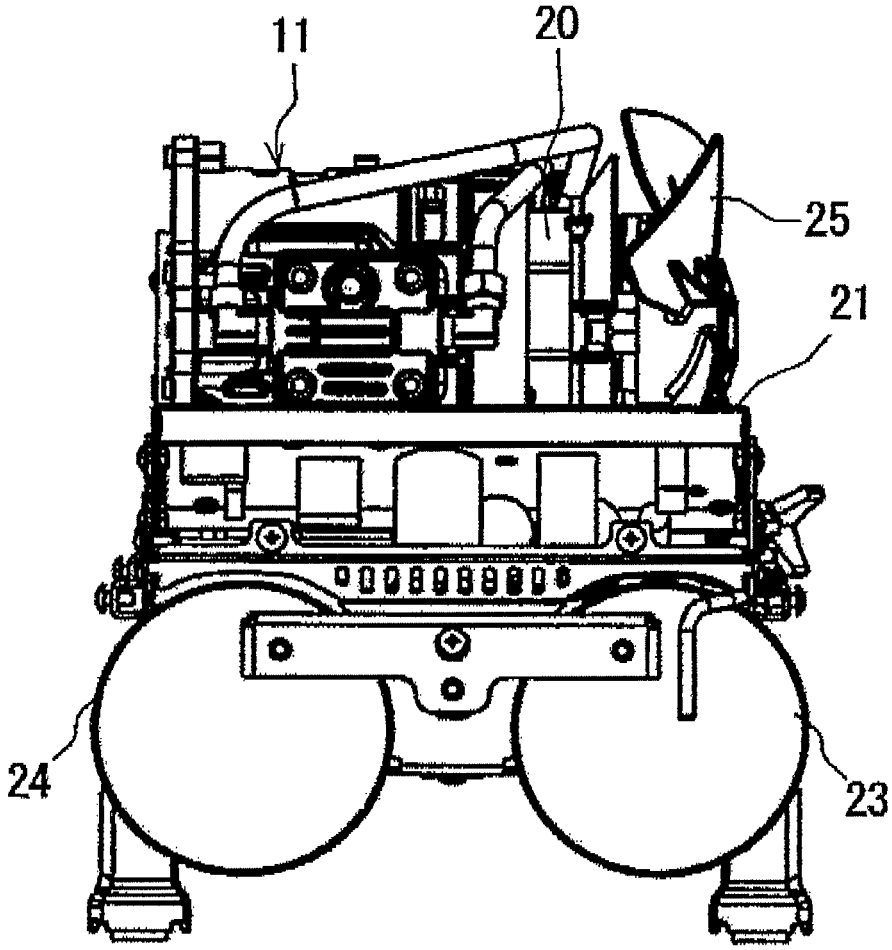
FIG. 4 is a side view of the air compressor from which the cover is removed.

As shown in FIGS. 3A to 4, a fan 25 is mounted on the rotary shaft 20*a* of the motor 20 on the opposite side from the crankcase 12. When the motor 20 is driven, the fan 25 rotates together with the rotary shaft 20*a* to supply cooling air.

As shown in FIGS. 1A to 2, the cover 27 includes an air intake portion 27*a* having a plurality of inlets formed through a portion covering the fan 25, so that the air can be taken into the cover 27 through the intake portion 27*a*. The cover 27 also includes an air discharge portion 27*b* having a plurality of outlets formed through a portion opposite to the intake portion 27*a*, so that the air taken in from the intake portion 27*a* can be discharged. As shown in FIGS. 1A and 1B, the intake portion 27*a* is provided with a V-shaped reinforcing portion 27*c* such that a gap is formed between the intake portion 27*a* and the reinforcing portion 27*c* through which the air is allowed to flow. Similarly, the discharge portion 27*b* is also provided with a reinforcing portion 27*c*. The reinforcing portions 27*c* ensure the strength of the cover 27. That is, by providing the reinforcing portions 270, the occupation area ratio of the inlets and outlets is increased so that the air suction and discharge performance is improved, and at the same time, the strength of the cover 27 is ensured.

As shown in FIG. 2, in addition to the intake portion 27*a* and discharge portion 27*b*, the cover 27 includes side slits 27*d* in a side surface of the cover 27 to increase air intake and discharge amount. The side slits 27*d* are formed in a portion to which the upper end portion of the inverter board 21 faces and, as will be described later, discharges the cooling air that has flowed along the upper surface 21*a* of the inverter board 21.

The respective components of the air compressor 10 are arranged as follows.

That is, as shown in FIGS. 3A to 4, in the bottom portion of the air compressor 10, the first and second tanks 23, 24 are arranged in a parallel manner. The fan 25, motor 20 and compressor main body 11 are arranged in a row in this order above the first and second tanks 23, 24. As shown in FIG. 7, the rotary shaft 20*a* of the motor 20 is arranged substantially perpendicularly to the longitudinal direction of the first and second tanks 23, 24.

The primary cylinder 13*a* of the primary compression mechanism 13 and the secondary cylinder 14*a* of the secondary compression mechanism 14 protrude from the crankcase 12 in a direction perpendicular to the rotary shaft 20*a* of the motor 20. In other words, the axes of the primary cylinder 13*a* and secondary cylinder 14*a* are arranged perpendicularly to the rotary shaft 20*a* of the motor 20.

As shown in FIGS. 3A and 3B, the inverter board 21 is arranged below the secondary cylinder 14*a* and above the first and second tanks 23, 24. The inverter board 21 is inclined such that its outer side is higher and such that the inverter board 21 becomes closer to the secondary cylinder 14*a* toward the outer side. The inverter board 21 is disposed such that, when the air compressor is projected on the ground, it does not protrude outward than the most protruded portions of the first and second tanks 23, 24.

Next, flows of the cooling air will be described.

As shown in FIG. 7, the fan 25 is disposed on the air intake side, and takes in the external air from the intake portion 27*a* and supplies the cooling air toward the discharge portion 27*b*.

Figure 6:
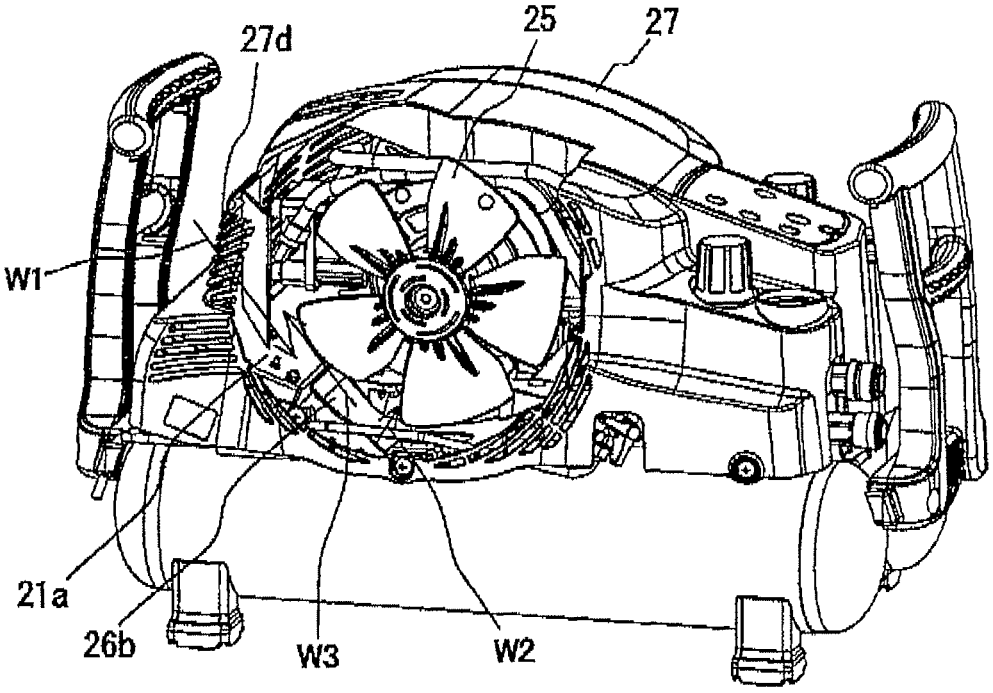
FIG. 6 is a perspective view of a portion of the air compressor, illustrating flows of cooling air inside the air compressor.
Figure 8:
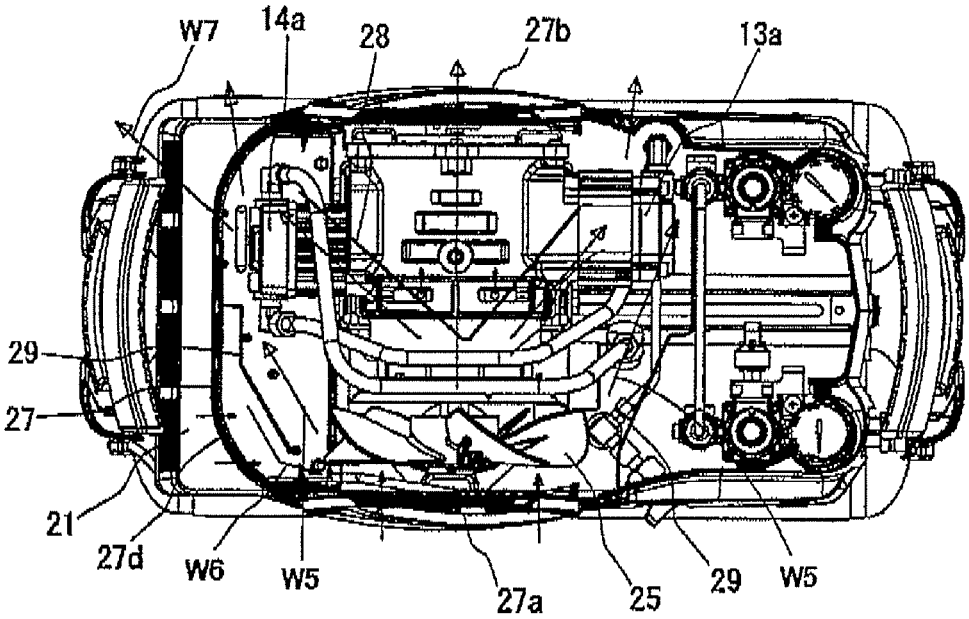
FIG. 8 is a sectional view of the air compressor taken along the line VIII-VIII in FIG. 1B, illustrating flows of the cooling air inside the air compressor.

The air is taken in not only from the intake portion 27*a* but also from the side slits 27*d* near the intake portion 27*a* (see W1 in FIG. 6 and W6 in FIG. 8). That is, the region on an inner side of the side slits 27*d* is divided by an air guide wall portion 29 into a intake portion 27*a* side and a discharge portion 27*b* side, so that the external air is taken in from the side slits 27*d* on the intake portion 27*a* side along the air guide wall portion 29.

Similarly, the air is discharged not only from the discharge portion 27*b* but also from the side slits 27*d* near the discharge portion 27*b* (see W7 in FIG. 8). That is, the region on the inner side of the side slits 27*d* is divided by the air guide wall portion 29 into the intake portion 27*a* side and discharge portion 27*b* side, so that the air is discharged from the side slits 27*d* on the discharge portion 27*b* side along the air guide wall portion 29 and the inner wall of the cover 27.

Next, with regard to the cooling air supplied by the fan 25, flows in the lower region of the cover 27 will be described.

Figure 5A:
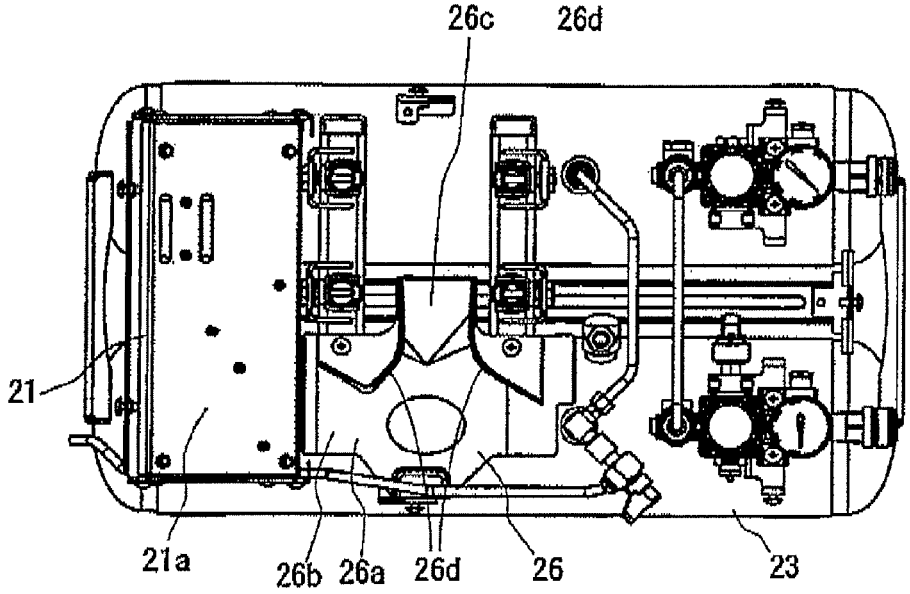
FIG. 5A is a plan view of the air compressor from which the cover, a motor and a compressor main body are removed.
Figure 5B:
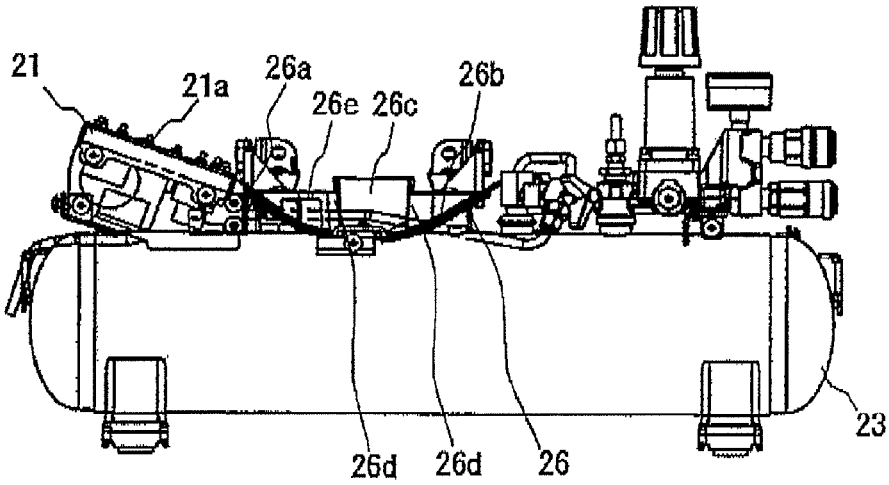
FIG. 5B is a front view of the air compressor from which the cover, the motor and the compressor main body removed are removed.

As shown in FIGS. 5A and 5B, the air compressor 10 includes an air guide plate 26 between the motor 20 and the first tank 23. The air guide plate 26 extends from an area near of the intake portion 27*a* toward the discharge portion 27*b* along the flow direction of the cooling air, and generates the flow of the cooling air in the lower region of the cover 27. The air guide plate 26 includes a first air guide portion 26*a* configured to distribute the cooling air toward the inverter board 21 and a second air guide portion 26*c* configured distribute the cooling air toward the motor 20.

As shown in FIG. 5B, the first air guide portion 26*a* is formed to have an arc shape when viewed in the axial direction of the rotary shaft 20*a*. The first air guide portion 26*a* distributes the cooling air toward the inverter board 21 such that the cooling air flows along the arc shape of the first air guide portion 26*a* (see W3 in FIG. 6). The air guide plate 26 also includes an upright portion 26*d* formed on the downstream side of the cooling air to distribute the cooling air toward the inverter board 21. That is, the cooling air collides with the upright portion 26*d* and flows along the upright portion 26*d* so that the cooling air is easily distributed laterally toward the inverter board 21. An air guide hole 26*e* is formed through the upright portion 26*d*. The air guide hole 26*e* communicates with a region below the inverter board 21. Thus, a part of the cooling air having collided with the upright portion 26*d* is supplied toward the lower surface of the inverter board 21 through the air guide hole 26*e*, and is used to cool the lower surface of the inverter board 21.

The first air guide portion 26*a* is disposed such that a side portion facing the inverter board 21 is arranged along the inverter board 21. That is, the upper surface 26*b* of the first air guide portion 26*a* and the upper surface 21*a* of the inverter board 21 are arranged to form a substantially continuous plane. Thus, the cooling air guided by the first air guide portion 26*a* flows smoothly along the upper surface 21*a* of the inverter board 21, and is used to cool the upper surface of the inverter board 21.

The cooling air flowing along the upper surface 21*a* of the inverter board 21 is guided along the upper surface 21*a* of the inverter board 21 toward the secondary cylinder 14*a*. The cooling air that has been used to cool the secondary cylinder 14*a* is discharged from the side slits 27*d* to the outside.

As shown in FIGS. 5A, 5B and 7, the second air guide portion 26*c* is formed continuously from the downstream side of the first air guide portion 26*a*, and is extended in an upwardly inclined manner toward the downstream of the airflow. The second air guide portion 26*c* guides the cooling air in the lower region of the cover 27 slightly upward toward the motor 20 (see W2 in FIG. 6 and W4 in FIG. 7). The guided cooling air cools the compressor main body 11 including the motor 20, and is then discharged from the discharge portion 27*b* and the side slits 27*d*.

Next, the flow of the cooling air in the upper region of the cover 27 will be described.

As shown in FIGS. 7 and 8, in the upper region inside of the cover 27, a V-shaped wall portion 28 is provided. The wall portion 28 has a V shape when viewed from above such that it spreads from the upstream toward the downstream of the cooling air. Therefore, as shown in FIG. 7, the cooling air W5 flowing in the upper region of the cover 27 collides with the V-shaped wall portion 28 and, as shown in FIG. 8, is distributed in the directions toward the primary cylinder 13*a* and the secondary cylinder 14*a* respectively. Thus, a sufficient amount of cooling air is supplied to the primary cylinder 13*a* and the secondary cylinder 14*a*. The cooling air distributed to the secondary cylinder 14*a* is also used to cool the inverter board 21.

According to the exemplary embodiment described above, the first and second tanks 23, 24 are disposed below the secondary cylinder 14*a* and the motor 20, and the inverter board 21 is interposed between the secondary cylinder 14*a* and the first and second tanks 23, 24. That is, the inverter board 21 is not interposed between the first and second tanks 23, 24. Therefore, a space between the two tanks 23, 24 can be reduced, so that the projected area of the air compressor at the time of installation can be reduced. Also, the inverter board 21 is disposed above the first and second tanks 23, 24. Therefore, the lower portion of the inverter board 21 is protected by the first and second tanks 23, 24. Thus, even when the air compressor 10 is dropped onto stones or wood pieces, its safety can be ensured.

The axis of the motor 20 is substantially perpendicular to the longitudinal direction of the first and second tanks 23, 24 and also is substantially perpendicular to the axes of the primary cylinder 13*a* and the secondary cylinder 14*a*. That is, the axes of the primary cylinder 13*a* and the secondary cylinder 14*a* are arranged along the longitudinal direction of the first and second tanks 23, 24. Accordingly, the primary cylinder 13*a* and the secondary cylinder 14*a* can be arranged within the longitudinal dimension of the first and second tanks 23, 24 without protruding therefrom. This can further reduce the projected area of the air compressor 10 at the time of installation.

The inverter board 21 is arranged such that, when the air compressor is projected onto the ground, it does not protrude outward than the most protruding portions of the first and second tanks 23, 24. This can further reduce the projected area of the air compressor 10 at the time of installation.

The inverter board 21 is inclined such that the inverter board approaches the secondary cylinder 14*a* as it extends toward the outside of the air compressor 10. Therefore, even when the inverter board 21 is increased in size, the inverter board 21 can be prevented from protruding, thereby being able to reduce the projected area of the air compressor 10 at the time of installation. Further, the cooling air that has flowed toward the inverter board 21 cools the inverter board 21, and is guided toward the secondary cylinder 14*a* to also cool the secondary cylinder 14*a*. Therefore, the air compressor 10 can be cooled efficiently.

The air guide plate 26 is provided along the direction of the cooling air and between the motor 20 and the first tank 23. Therefore, the cooling air can be guided to a dead space between the motor 20 and the first tank 23, and this cooling air can be guided in desired directions by the air guide plate 26.

Although the air sending direction of the fan 25 is not along in the longitudinal direction of the first and second tanks 23, 24, the air can be guided efficiently by the air guide plate 26. Specifically, the air guide plate 26 includes the first air guide portion 26*a* configured to distribute the cooling air toward the inverter board 21 and the second air guide portion 26*c* configured to distribute the cooling air toward the motor 20. Thus, the air guide plate 26 can distribute the cooling air from the fan 25 toward the inverter board 21 and toward the motor 20.

The upper surface 21*a* of the inverter board 21 and the upper surface 26*b* of the first air guide portion 26*a* are disposed to form a substantially continuous plane. Therefore, the cooling air that has flowed along the upper surface 26*b* of the first air guide portion 26*a* can be guided smoothly to the inverter board 21.

The V-shaped wall portion 28 is provided inside the cover 27. The V-shaped wall portion 28 has a V shape when viewed from above such that the wall portion 28 expands from the upstream side to the downstream side of the cooling air. Therefor; the cooling air can be guided in a wide range.

The cover 27 is formed such that the external air can be taken in from the side surface of the cover 27, and the air guide wall portion 29 is provided to guide the air taken in from the side surface of the cover 27 toward the upstream of the cooling air, That is the air is taken in also from the side of the cover 27, thereby being able to supply a large amount of cooling air.

In the above exemplary embodiment, the fan 25 is arranged coaxially with the motor 20. However, for example, the driving force of the motor 20 may be transmitted using a belt and a pulley or the like, and the fan 25 may be provided on a different axis other than the shaft of the motor 20 to supply cooling air.

What is claimed is:

1. An air compressor comprising:

a compression mechanism including a cylinder to generate compressed air;

a motor provided to drive the compression mechanism;

an inverter board including an inverter to control a rotation of the motor;

two elongated tanks provided to store the compressed air generated by the cylinder; and a fan rotated by the motor to supply cooling air, wherein the tanks are arranged below the cylinder and the motor, and wherein the inverter board is arranged between the cylinder and the tanks such that the inverter board is arranged below the cylinder and above the tanks and such that the inverter board is not interposed between the tanks.

2. The air compressor according to claim 1, wherein a shaft of the motor is perpendicular to a longitudinal direction of the tanks and is perpendicular to an axis of the cylinder.

3. The air compressor according to claim 1, wherein the inverter board is arranged such that the inverter board does not protrude outward of the tanks in a longitudinal direction of the tanks.

4. The air compressor according to claim 1, wherein the inverter board is arranged in an inclined manner such that the inverter board becomes closer to the cylinder as the inverter board extends toward an outside of the air compressor.

5. The air compressor according to claim 1, further comprising an air guide plate provided to extend along a direction of the cooling air, wherein the air guide plate is arranged between the motor and the tanks.

6. The air compressor according to claim 5, wherein the air guide plate includes a first air guide portion configured to distribute the cooling air toward the inverter board and a second air guide portion configured to distribute the cooling air toward the motor.

7. The air compressor according to claim 6, wherein the air guide plate is arranged such that an upper surface of the first air guide portion extends along the upper surface of the inverter board.

8. The air compressor according to claim 1, further comprising a wall portion having a V-shape when viewed from above such that the wall portion expands from an upstream toward a downstream of the cooling air.

9. The air compressor according to claim 1, further comprising a cover arranged to cover the compression mechanism and the motor; and an air guide wall portion formed inside the cover, wherein the cover comprises a side surface configured to take in external air, and the air guide wall portion guides the air taken in from the side surface of the cover toward an upstream of the cooling air.

* * * * *